US012024883B2

(12) United States Patent
Eronen et al.

(10) Patent No.: US 12,024,883 B2
(45) Date of Patent: Jul. 2, 2024

(54) THERMAL INSULATION PLATE AND ITS USE

(71) Applicant: FINNFOAM OY, Salo (FI)

(72) Inventors: Jouni Eronen, Piikkiö (FI); Juha Laaksonen, Paimio (FI)

(73) Assignee: FF-FUTURE OY, Salo (FI)

( * ) Notice: Subject to any disclaimer, the term of this patent is extended or adjusted under 35 U.S.C. 154(b) by 0 days.

(21) Appl. No.: 17/769,071

(22) PCT Filed: Oct. 15, 2020

(86) PCT No.: PCT/FI2020/050681

§ 371 (c)(1),
(2) Date: Apr. 14, 2022

(87) PCT Pub. No.: WO2021/074493

PCT Pub. Date: Apr. 22, 2021

(65) Prior Publication Data

US 2024/0102281 A1 Mar. 28, 2024

(30) Foreign Application Priority Data

Oct. 16, 2019 (FI) ..... 20195890

(51) Int. Cl.
*E04B 5/38* (2006.01)

(52) U.S. Cl.
CPC ..... *E04B 5/38* (2013.01)

(58) Field of Classification Search
None
See application file for complete search history.

(56) References Cited

U.S. PATENT DOCUMENTS 4,811,770 A * 3/1989 Rapp ..... E04C 2/06 52/332
5,809,722 A * 9/1998 Bertsche ..... E04B 5/23 52/630
6,898,908 B2 * 5/2005 Messenger ..... E04C 2/044 52/406.1

(Continued)

FOREIGN PATENT DOCUMENTS

CN 2371242 Y 3/2000
CN 1840818 A 10/2006

(Continued)

OTHER PUBLICATIONS

International Search Report and Written Opinion dated Feb. 17, 2021, from International Application No. PCT/FI2020/050681, 8 pages.

(Continued)

*Primary Examiner* — Joshua K Ihezie
(74) *Attorney, Agent, or Firm* — Meunier Carlin & Curfinan LLC

(57) ABSTRACT

A thermal insulation plate (1), which is manufactured from cellular plastic, and the upper surface of which comprises grooves (5*a*, 5*b*), which are arranged in two directions over the area of the entire surface. The thermal insulation plate comprises at least in part of the groove (5*a*, 5*b*) intersections a spacer (6, 6*a*, 6*b*) for installing reinforcement, which is formed from thermal insulation material as a fixed part of the thermal insulation plate.

9 Claims, 2 Drawing Sheets

(56) References Cited

U.S. PATENT DOCUMENTS

| | | | | |
|---|---|---|---|---|
| 7,100,336 | B2 * | 9/2006 | Messenger | E04C 2/044 52/794.1 |
| 7,954,291 | B2 * | 6/2011 | Cretti | E04B 5/36 52/332 |
| 2005/0086906 | A1 * | 4/2005 | Bathon | E04C 3/29 52/782.1 |
| 2006/0185280 | A1 * | 8/2006 | Cretti | E04C 5/0653 52/309.12 |

FOREIGN PATENT DOCUMENTS

| | | | |
|---|---|---|---|
| CN | 1884742 | A | 12/2006 |
| EP | 0274067 | A1 | 7/1988 |
| WO | 2013019134 | A1 | 2/2013 |
| WO | 2014196878 | A1 | 12/2014 |

OTHER PUBLICATIONS

Finnish Search Report in FI Application No. 20195890 dated Apr. 21, 2020, 2 pages.

* cited by examiner

THERMAL INSULATION PLATE AND ITS USE

CROSS REFERENCE TO RELATED APPLICATIONS

This application is a United States National Phase Patent Application of International Patent Application Number PCT/FI2020/050681, filed on Oct. 15, 2020, which claims the benefit of priority to Finnish National Patent Application number 20195890, filed on Oct. 16, 2019, both of which are incorporated by reference herein in their entireties.

OBJECT OF THE INVENTION

The invention relates to a thermal insulation plate and its use, especially in floor structures, according to the preamble of the appended independent claim. The invention also relates to a prefabricated structural element, which comprises a thermal insulation plate according to the invention.

BACKGROUND OF THE INVENTION

In cast floor structures the reinforcement, such as reinforcement mesh or other corresponding reinforcement rods, are typically installed in the casting compound layer on top of the thermal insulation material layer. The purpose of the reinforcement is to keep so-called shrinkage cracks at a minimum and to receive vertical loads. Spacers or other corresponding support pieces are used in installing the reinforcement, so that the reinforcements can be installed in the casting compound layer.

Reinforcements used in cast structures are typically set in the structure with the aid of separate reinforcement spacers. Typically in reinforcement intersections, the reinforcements are further bound together, if separate deformed steel bars or corresponding reinforcement rods are used. Thus, they cannot move during the casting. Using separate reinforcement spacers is, however, time-consuming and laborious.

OBJECT AND DESCRIPTION OF THE INVENTION

An object of the present invention is to reduce or even eliminate the above-mentioned problems appearing in prior art.

An object of the present invention is to present a thermal insulation plate, which has ready-made reinforcement spacers. Thus, there is no need to use separate spacers or other corresponding parts in connection with installation of the reinforcement with the thermal insulation plate according to the invention. An object of the invention is further to present a thermal insulation plate, with which a good strength is achieved in the reinforcement intersections.

An object of the thermal insulation plate according to the invention is to make possible a quick and easy way of arranging reinforcements in a structure, such as a floor structure.

In order to attain the above-described objects, the thermal insulation plate according to the invention is primarily characterized in what is presented in the characterising part of the independent claim.

A typical thermal insulation plate according to the invention is manufactured from cellular plastic and comprises a lower surface and an upper surface, of which the upper surface comprises grooves, which are arranged in two directions over the area of the entire surface, and in at least a part of the groove intersections the thermal insulation plate comprises a spacer for installing reinforcement, which spacer is formed from thermal insulation material as a fixed part of the thermal insulation plate and which spacer is arranged in the centre of the groove intersection, so that a recess surrounds the spacer at least partly, preferably there is a recess around the spacer substantially around the entire spacer and the spacer comprises a cavity in the middle of the spacer, which cavity is arranged in the spacer substantially through the entire height of the spacer and the cavity is arranged in a different direction than the grooves in the thermal insulation plate.

There is no need to use separate spacers or other corresponding parts in the installation of the reinforcement with the thermal insulation plate according to the invention.

The thermal insulation plate according to the invention can be used in floor structures, where the thermal insulation material layer is typically formed by arranging thermal insulation plates according to the invention beside each other. Reinforcements required for the floor structure are set in the grooves of the thermal insulation plates according to the invention, whereby they are supported by the spacers in the thermal insulation board and a casting compound layer can be cast on top of the thermal insulation plates. A typical floor structure according to the invention comprises

- an insulation material layer, which is formed in the floor structure from thermal insulation plates according to the invention,
- reinforcement rods, which are arranged at least in part of the grooves in the insulation material layer, and
- a casting compound layer, which is arranged on the surface of the insulation material layer.

A thermal insulation plate according to the invention can also be used in prefabricated structural elements, in which the thermal insulation plate according to the invention forms the thermal insulation material layer of the structural element. Typically, a prefabricated structural element according to the invention further comprises reinforcement rods arranged at least in part of the grooves in the insulation material layer, and a casting compound layer, which is arranged on the surface of the insulation material layer.

In a typical thermal insulation plate according to the invention the fixed spacers for installing the reinforcement are arranged in the intersections of the grooves in the thermal insulation plate, whereby recesses have been arranged for the casting compound also around the spacers, whereby the strength can be made good also in the reinforcement intersections, because the casting compound can be arranged in a continuous manner on all sides of the spacer.

The spacers of the thermal insulation plate according to a preferred embodiment of the invention comprise an cavity, typically a deep groove has been formed in the middle of the spacers, which makes possible threading reinforcement wires underneath crossing reinforcement rods and thus their easy binding. Additionally, this cavity or groove is filled with casting compound, which improves the strength. In a thermal insulation plate according to a preferred embodiment of the invention, the casting compound surrounds the spacer in the intersection of the grooves in the thermal insulation material and additionally fills the cavity or groove in the reinforcement spacer itself, whereby a good strength is achieved due to the continuous casting compound layer.

Additionally, the spacers formed from thermal insulation material in the bottom of the grooves arrange the reinforcements in the correction position and thus make installation of the reinforcement easier and quicker. The spacers arranged in the intersection of the grooves in the thermal insulation plate according to the invention also keep the reinforcement at the correct height and in place during the casting.

A thermal insulation plate according to the invention can be manufactured from any thermal insulation material suitable for the purpose. A typical thermal insulation plate according to the invention is manufactured from cellular plastic. According to one embodiment of the invention, the thermal insulation plate comprises expanded polystyrene (EPS), expanded polyethene (EPE), expanded polypropene (EPP), polyurethane (PUR), polyisocyanurate (PIR) or expanded polystyrene (XPS). According to a preferred embodiment of the invention, the thermal insulation plate is manufactured from cellular plastic material suitable for casting mould technique. According to one embodiment of the invention, the thermal insulation plate can be manufactured from cellular plastics easily with the casting mould technique, whereby the spacers can easily be made a fixed part of the final product. According to a preferred embodiment of the invention, the thermal insulation plate comprises expanded polystyrene (EPS), expanded polyethene (EPE) or expanded polypropene (EPP), which are suitable especially for casting mould technique. Expanded polystyrene, expanded polyethene and expanded polypropene can also be called foamed polystyrene, foamed polyethene and foamed polypropene. A sufficient compression strength is typically also required from the thermal insulation plate according to the invention. Typically, the thermal insulation plate according to the invention is manufactured from a thermal insulation material, such as cellular plastic, the compression strength of which is at least 50 kPa (short-term compression strength according to standard EN 826), typically the compression strength is between 50-2000 kPa and most typically between 100-700 kPa.

A typical thermal insulation plate according to the invention comprises a lower surface, and upper surface and side surfaces delimiting the surfaces, of which the upper surface comprises elongated grooves, which are arranged in two directions over the area of the entire surface of the thermal insulation plate. According to a preferred embodiment of the invention, the grooves are arranged in two directions, substantially perpendicular to each other, forming a checkered grooving in the plate surface. According to one embodiment of the invention, the upper surface of the thermal insulation plate comprises elongated grooves in the longitudinal and lateral direction of the thermal insulation plate substantially over the entire surface, whereby the grooves extend in the longitudinal and lateral direction substantially over the entire plate. In these grooves it is possible to arrange reinforcement strengthening the structure, such as reinforcement rods and/or a reinforcement mesh.

The distance (measured from centre to centre) between the grooves in the upper surface of the thermal insulation plate according to the invention can vary. According to a preferred embodiment of the invention, the distance between the grooves can be approximately 50-600 mm. The distance between the grooves may also be different in the lateral direction and the longitudinal direction of the plate. In a thermal insulation plate according to an embodiment of the invention, grooves are arranged at approximately 300 mm intervals (measured from centre to centre) in the longitudinal and lateral direction of the plate, this is an advantageous solution for obtaining sufficient strength for example in a floor structure, when reinforcement is arranged in all grooves. The distance between grooves can also vary depending on the application and the material used in the thermal insulation plates. Additionally, the number of grooves can vary. The width of the grooves can also vary, depending on the required properties and the application. In one exemplary embodiment according to the invention, the width of the grooves is approximately 40-100 mm or 50-80 mm or 50-60 mm. In the same way, the depth of the grooves can vary, for example the depth of the grooves is approximately 40-100 mm or 50-80 mm, depending on the thickness of the thermal insulation plate. In a typical embodiment according to the invention, the depth of the grooves is about 50-60 mm. The thickness of the thermal insulation plate according to the invention is larger than the depth of the grooves in the plate. In one embodiment, the depth of the grooves can even be 200-300 mm, when floor structures are made, which require a thicker casting compound layer. The amount of casting compound needed can be reduced with the thermal insulation plate according to the invention. Additionally, the shape of the grooves, such as the shape of the walls and bottom part, can vary and be freely selected. In one embodiment of the invention, the groove narrows toward the bottom part of the groove, i.e. the upper surface of the groove is wider than the lower surface of the groove.

Typically, the thickness of the thermal insulation plate according to the invention is between 50-500 mm or 80-300 mm, measured between the planar surfaces of the plate.

The thermal insulation plate according to the invention comprises a spacer at least in part of the groove intersections, which spacer is formed from thermal insulation material as a fixed part of the thermal insulation plate. According to a preferred embodiment of the invention, the thermal insulation plate comprises a spacer in all groove intersections, whereby the reinforcement rods and/or reinforcement mesh used in reinforcement are supported in all intersections. The spacer is a block rising up from the level of the bottom of the grooves, which is formed as a fixed part of the same material as the thermal insulation plate.

In the thermal insulation plate according to the invention, the spacer is arranged in the centre of the groove intersection, so that the recesses surround the spacer at least partly, advantageously there are recesses around the spacer substantially around the entire spacer. Thus the casting compound can be arranged around the spacer and the structure can be given a good strength also in the groove intersections. The recesses around the spacer are typically connected to the grooves in the thermal insulation plate, i.e. the grooves in the thermal insulation plate surround the spacer in the groove intersections.

In a thermal insulation plate according to a preferred embodiment of the invention, the upper surface of the spacer is lower than the upper surface of the thermal insulation plate. Thus the spacer remains inside the casting compound layer, when casting compound is arranged in the grooves of the thermal insulation plate. In an exemplary thermal insulation plate, the depth of the groove can be 50-60 mm and the height of the spacer measured from the bottom of the groove is approximately 40 mm.

The spacer in the thermal insulation plate according to the invention comprises a cavity in the middle of the spacer. Typically, the cavity extends through the spacer, whereby it is open at the side surfaces of the spacer, i.e. the cavity is a groove extending through the spacer. The cavity in the spacer is arranged in the spacer substantially through the entire height of the spacer.

This cavity makes it possible to easily thread reinforcement wire underneath the crossing reinforcement rods, whereby the reinforcement rods remain in the correct place during the casting of the casting compound. In one embodiment of the invention, the cavity in the spacer is arranged in a different direction than the grooves in the thermal insulation plate, whereby threading reinforcement wires is easier. The thermal insulation plate according to a preferred embodiment of the invention comprises a spacer, which has a deep V-groove in the middle of the spacer.

The spacer according to one embodiment of the invention comprises shapes in the upper surface of the spacer in the direction of the grooves, which shapes help keep the reinforcement in the correct place during casting, whereby the structure to be cast can obtain a uniform quality with regards to reinforcement. These shapes also speed up the setting in place of the reinforcement, because they guide the reinforcement into the correct place.

Thermal insulation plates according to the invention can be manufactured in different sizes. According to one embodiment of the invention, the thermal insulation material plates have a size of for example 600×1200 mm or 600×2400 mm or 1200×1200 mm or 1200×2400 mm. The thermal insulation plates according to the invention can be used to form larger insulation elements.

According to one embodiment according to the invention, the thermal insulation plates can be used to form an insulation material layer, where two or more thermal insulation plates according to the invention are set tightly against each other. According to a typical embodiment of the invention, thermal insulation plates to be set tightly against each other comprise a tongue and groove or other corresponding shaping on its side surfaces, which makes possible the attaching of the plates to each other.

According to one embodiment of the invention, an insulation material layer of a floor structure is formed from the thermal insulation plates, and reinforcements required for the floor structure are arranged in the grooves of the thermal insulation plates according to the invention and a casting compound layer on top of the reinforcements, whereby the casting compound also fills the grooves in the thermal insulation plate. The grooves of the thermal insulation plate and the therein arranged reinforcements make possible a reduction in the amount of casting compound in the floor structure to be cast. The grooves in the thermal insulation plate still ensure good adhesion of the casting compound to the insulation material. Due to the thinner casting compound layer, the setting times of the casting compound layer shorten. Additionally, the thermal insulation plates according to the invention speed up the manufacturing of for example a floor structure, because the reinforcements can be easily and quickly set in place due to the spacers ready in the thermal insulation plate.

A thermal insulation plate according to the invention can also be used in prefabricated structural elements, which comprise reinforcement and a casting compound layer, in addition to the thermal insulation material layer. The floor structure can for example be built from prefabricated structural elements, which comprise, in addition to the thermal insulation plate according to the invention, reinforcement and a casting compound layer. Thus, the manufacturing of the floor structure can be further sped up, because at the building site, you only need to seal the seams between the prefabricated structural elements and/or cast from the casting compound a thinner surface layer onto the surface of the prefabricated structural elements or otherwise coat the surface formed by the structural elements.

According to one embodiment of the invention, the prefabricated structural element comprises a thermal insulation material layer formed from one or more thermal insulation plates according to the invention, reinforcement rods or corresponding reinforcements arranged at least in part of the grooves in the thermal insulation material layer and a casting compound layer, which is arranged on the surface of the thermal insulation material layer.

According to one embodiment of the invention, the prefabricated structural element comprises a casting compound layer, which is arranged on the surface of the insulation material layer formed by the thermal insulation plates, forming the planar upper surface of the structural element, so that the surface area of the upper surface formed by the casting compound layer is typically smaller than the surface area of the insulation material layer, whereby in at least two edges of the structural element there is a visible planar edge formed by the insulation material layer below the casting compound layer. In the prefabricated structural element according to an embodiment of the invention, the reinforcement rods or corresponding reinforcements are arranged at least in part of the grooves in the thermal insulation material layer, and the ends of the reinforcement rods extend outside the side surface of the structural element formed by the thermal insulation plates. These ends of the reinforcement rods extending outside of the side surfaces of the structural element make it possible to attach structural elements together and at the same time ensure the strength of the structure manufactured from the prefabricated structural elements over the entire area of the structure, also at the connecting point between structural elements.

In a preferred prefabricated structural element according to the invention, there is around the casting compound layer a planar edge formed by the insulation material layer below the casting compound layer on all edges of the structural element, i.e. the edge circles around the structural element. The casting compound layer thus does not cover the entire insulation material layer, but the insulation material layer remains visible on the edges of the structural element. According to a typical embodiment of the invention, the width of the planar edge formed by the insulation material layer around the casting compound layer is substantially the same as the length, over which the ends of the reinforcement rods extend outside the side surface of the structural element formed by the insulation material layer. Thus, when arranging two structural elements beside each other, the ends of the reinforcement rods arrange on top of the planar edge formed from insulation material of the adjacent structural element. Thus, the connecting points between the prefabricated structural elements can be made durable, when the reinforcement rods are substantially overlapping in the seam points and the support reinforcement can be made continuous over the entire area of the structure being formed. In a preferred embodiment according to the invention, the floor structure is formed from prefabricated structural elements, so that the reinforcement rods are substantially overlapping in the seam points of the structural elements.

In the prefabricated structural element according to the invention, the casting compound layer is typically formed from a concrete compound or a ceramic-based compound. The concrete compound can be any concrete compound suitable for the purpose, which comprises a binder. The concrete compound can be fibre-reinforced concrete, aerated concrete or the like. Alternatively, the casting compound layer formed on the surface of the insulation material layer can be formed from a ceramic-based casting compound suitable for the purpose. A second casting compound can be arranged in the seams between the prefabricated structural elements on top of the planar edge formed by the thermal insulation material layer of the structural elements, and thus the overlapping reinforcement rods of adjacently set structural elements remain in the seam points inside the second casting compound. A second casting compound layer formed from the second casting compound can additionally be arranged on the surface of the casting compound layer formed from the upper surface of the prefabricated structural elements. In a preferred embodiment of the invention, the second casting compound forms the seams between the prefabricated structural elements and the surface layer of the structure. The second casting compound is thus used as a seaming and surface compound.

The floor structure according to one embodiment of the invention can be formed by using prefabricated structural elements, so that structural elements are arranged tightly against each other substantially over the entire area of the floor surface to be formed, so that the insulation material layers of the structural elements arrange against each other. A second casting compound is arranged in indentations between prefabricated structural elements (between casting compound layers), whereby the seams between structural elements can be made durable. A second casting compound layer can be arranged on the surface of the casting compound layer formed from the prefabricated structural elements at the building site. Thus, casting compound must at the building site only be arranged in the seams between structural elements and, if so desired, a thin uniform surface layer of the floor structure can be formed from casting compound. The surface formed by the prefabricated structural elements can also be coated with some coating suitable for the purpose.

BRIEF DESCRIPTION OF THE DRAWINGS

In the following, the invention will be described in more detail with reference to the appended drawings, in which.

DETAILED DESCRIPTION OF THE DRAWINGS

Figure 1:
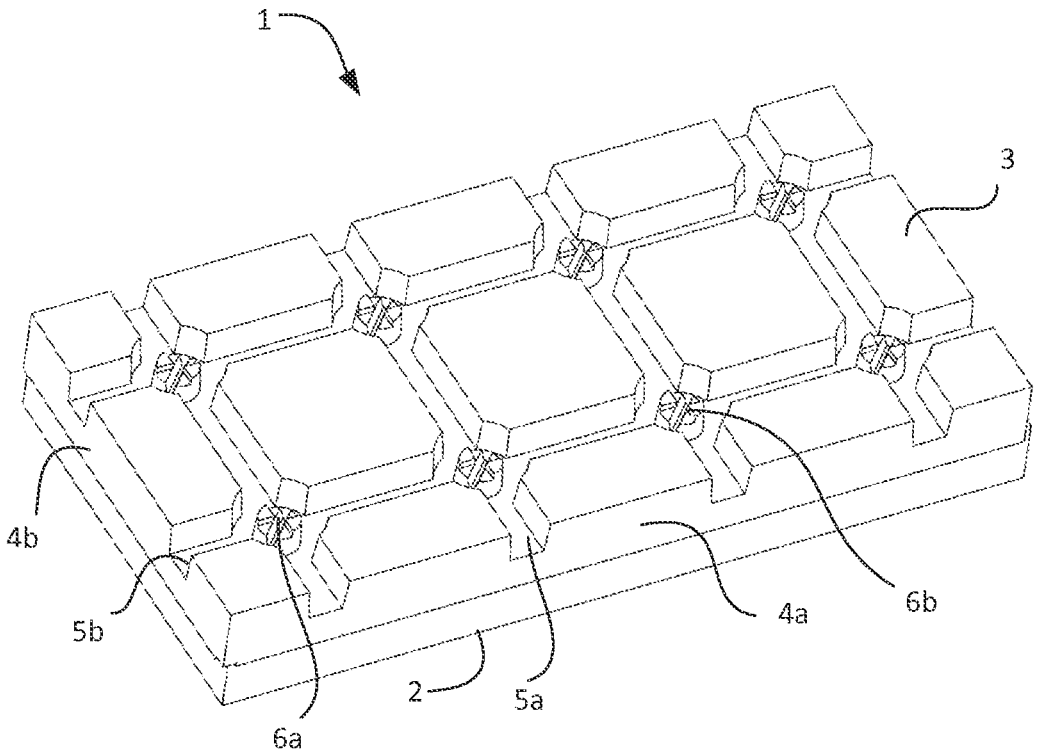
FIG. 1 shows a thermal insulation plate according to one embodiment of the invention.

FIG. 1 shows a thermal insulation plate 1 according to one embodiment of the invention, which comprises a lower surface 2, an upper surface 3 and side surfaces 4*a*, 4*b* delimiting the surfaces. The upper surface of the thermal insulation plate 1 comprises grooves 5*a*, 5*b*, which are arranged in two directions over the entire area of the surface. Typically, the upper surface 3 of the thermal insulation plate comprises elongated grooves 5*a*, 5*b* in the longitudinal and lateral direction of the plate, as shown in FIG. 1. The thermal insulation plate according to the invention comprises at least in part of the groove intersections 5*a*, 5*b* a spacer 6*a*, 6*b* for installing reinforcement, which spacer is formed from thermal insulation material as a fixed part of the thermal insulation plate. According to a preferred embodiment of the invention shown in FIG. 1, the thermal insulation plate 1 comprises a spacer 6*a*, 6*b* in all groove intersections.

Figure 2:
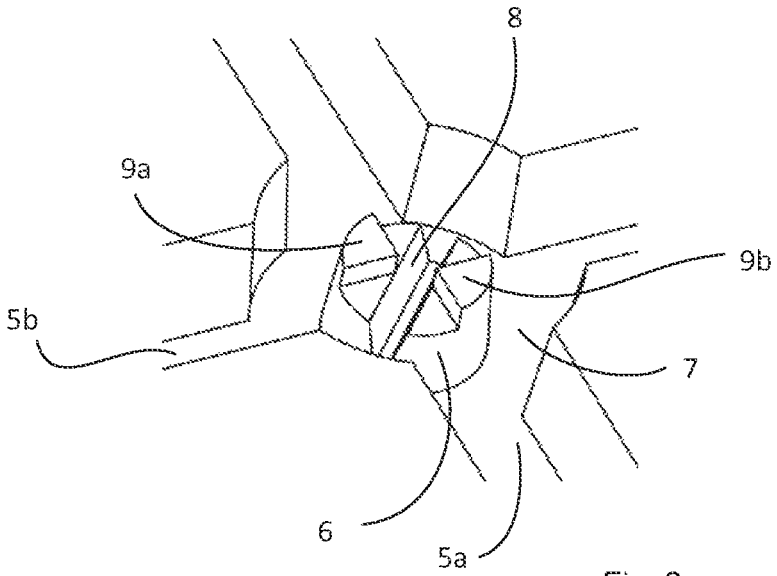
FIG. 2 shows in more detail a spacer in a thermal insulation plate according to one embodiment of the invention.

FIG. 2 shows in more detail a spacer 6 according to a preferred embodiment of the invention for installing reinforcement. The spacer 6 is arranged in the intersection between grooves 5*a*, 5*b* substantially in the centre, so that there is a recess 7 around the spacer 6 substantially around the entire spacer 6. In other words, the grooves in the thermal insulation plate surround the spacer in the groove intersections. Thus, the casting compound can easily be arranged to be uniform on all sides of the spacer 6. The spacer 6 is arranged in the intersection between grooves 5*a*, 5*b*, so that the upper surface of the spacer 6 is lower than the upper surface 3 of the thermal insulation plate, whereby the spacer remains inside the casting compound layer, when casting compound is arranged in the grooves. The spacer 6 according to a preferred embodiment of the invention shown in FIG. 2 comprises a cavity 8 in the middle of the spacer, which is for example a deep V-groove, which is open at the side surfaces of the spacer and typically extends to the bottom of the spacer. This cavity or groove makes possible the easy installation of reinforcement wire underneath crossing reinforcement rods. Additionally, the spacer 6 can comprise shapes 9*a*, 9*b* in the direction of the grooves in the upper surface of the spacer, which make easier the positioning of reinforcement and thus speed up the installation of reinforcement in its place. The shapes 9*a*, 9*b* shown in FIG. 2 are one exemplary manner of shaping the upper surface of the spacer 6.

Figure 3:
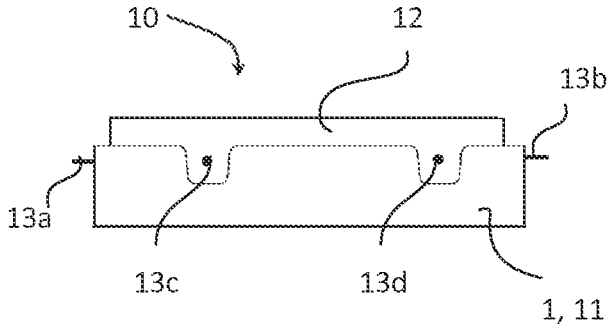
FIG. 3 shows a prefabricated structural element according to one embodiment of the invention, which comprises a thermal insulation plate according to the invention.

FIG. 3 illustrates a prefabricated structural element 10 according to one embodiment of the invention, which comprises a thermal insulation plate 1 according to the invention. The thermal insulation material layer 11 of the prefabricated structural element is formed from one or more thermal insulation plates 1 according to the invention. The casting compound layer 12 is formed on the surface of the thermal insulation material layer 11, forming a planar upper surface of the structural element, so that the surface area of the upper surface formed from the casting compound layer 12 is smaller than the surface area of the insulation material layer 11. Additionally, the prefabricated structural element 10 comprises reinforcement rods 13*a*, 13*b*, 13*c*, 13*d* arranged in grooves in the surface of the insulation material layer, typically in the longitudinal and lateral direction of the structural element. The reinforcement rods are arranged in the grooves in the surface of the insulation material layer, so that the ends of the reinforcement rods extend outside the side surface of the structural element 10 formed by the insulation material layer 11.

Figure 4:
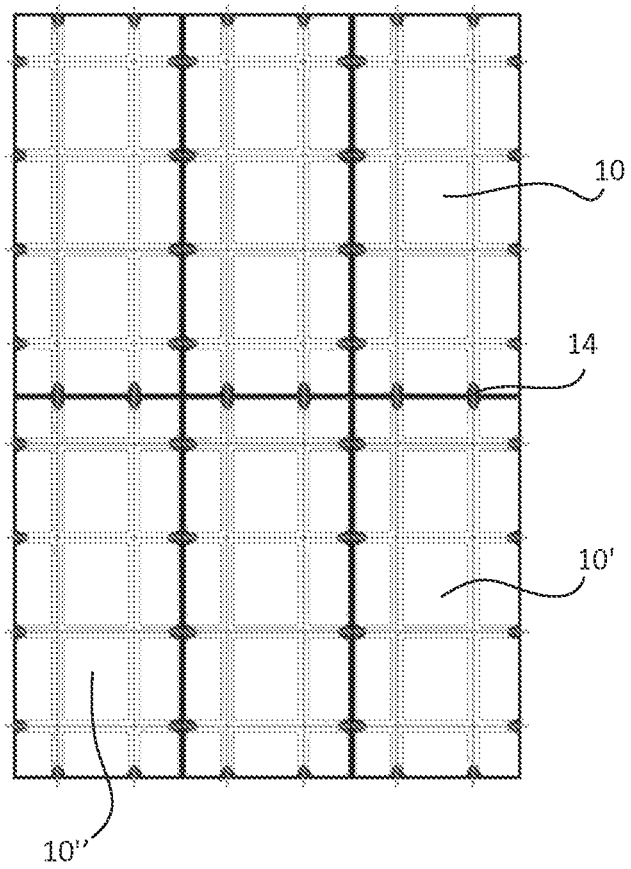
FIG. 4 shows as illustrated from above a structure, where prefabricated structural elements according to one embodiment of the invention are arranged adjacently.

FIG. 4 illustrates a structure formed from prefabricated structural elements 10, 10', 10" according to the invention, such as a floor structure, seen from above. Prefabricated structural elements 10, 10', 10" have been arranged adjacently, so that the insulation material layers of the prefabricated structural elements arrange tightly against each other and form a uniform surface. Casting compound is arranged in seam points 14 between casting compound layers of prefabricated structural elements, where the reinforcement rods of the structural elements arrange overlappingly. Additionally, a second casting compound layer can further be formed from casting compound on the surface of the prefabricated structural elements.

The invention claimed is:

1. A thermal insulation plate manufactured from cellular plastic, and comprising a lower surface and an upper surface, of which the upper surface comprises grooves arranged in two directions over an area of the entire upper surface forming groove intersections, wherein the thermal insulation plate comprises at least in a part of the groove intersections a spacer configured for installing a reinforcement the spacer being formed from thermal insulation material as a fixed part of the thermal insulation plate, and the spacer is being arranged in a centre of the groove intersection, so that a recess surrounds the spacer at least partly, and the spacer comprises a cavity in middle of the spacer, which cavity is arranged in the spacer substantially through an entire height of the spacer and the cavity is arranged in a different direction than the grooves in the thermal insulation plate.

2. The thermal insulation plate according to claim 1, wherein the thermal insulation plate comprises expanded polystyrene (EPS), expanded polyethene (EPE), expanded polypropene (EPP), polyurethane (PUR), polyisocyanurate (PIR) or expanded polystyrene (XPS).

3. The thermal insulation plate according to claim 1 wherein the upper surface of the thermal insulation plate comprises elongated grooves in the longitudinal and lateral directions of the plate.

4. The thermal insulation plate according to claim 1, wherein the cavity extends through the spacer, whereby the cavity is open at side surfaces of the spacer.

5. The thermal insulation plate according to claim 1, wherein the spacer comprises shapes in an upper surface of the spacer in the direction of the grooves.

6. The thermal insulation plate according to claim 1, wherein an upper surface of the spacer is lower than the upper surface of the thermal insulation plate.

7. A prefabricated structural element, which comprises an insulation material layer, a surface of which comprises grooves, reinforcement rods, which are arranged at least into a part of the grooves in the surface of the insulation material layer, a casting compound layer, which is arranged on the surface of the insulation material layer, wherein the insulation material layer is formed from one or more thermal insulation plates according to claim 1.

8. A floor structure, which comprises an insulation material layer, a surface of which comprises grooves, reinforcement rods, which are arranged at least into a part of the grooves in the surface of the insulation material layer, a casting compound layer, which is arranged on the surface of the insulation material layer, wherein the insulation material layer is formed in the floor structure from thermal insulation plates according to claim 1.

9. The thermal plate of claim 1, wherein the recess is substantially around the entire spacer.

* * * * *